United States Patent [19]

Huether, deceased et al.

[11] Patent Number: 5,016,437

[45] Date of Patent: May 21, 1991

[54] APPARATUS FOR CLEANING DIESEL ENGINE EXHAUST GAS

[75] Inventors: Werner M. Huether, deceased, late of Karlsfeld; by Berta L. Huether, heir, Fuerth; Axel Rossmann, Karlsfeld, all of Fed. Rep. of Germany

[73] Assignee: MTU Motoren- und Turbinen-Union Muenchen GmbH, Munich, Fed. Rep. of Germany

[21] Appl. No.: 402,049

[22] Filed: Sep. 1, 1989

[30] Foreign Application Priority Data

Sep. 9, 1988 [DE] Fed. Rep. of Germany ..... 3830761

[51] Int. Cl.[5] ..... F01N 3/02

[52] U.S. Cl. ..... 60/280; 60/303; 60/311; 60/605.1

[58] Field of Search ..... 60/280, 303, 311, 605.1, 60/597

[56] References Cited

U.S. PATENT DOCUMENTS

| | | | |
|---|---|---|---|
| 4,122,673 | 10/1978 | Leins | 60/280 |
| 4,535,589 | 8/1985 | Yoshida | 60/303 |
| 4,693,078 | 9/1987 | Dettling | 60/303 |
| 4,761,951 | 8/1988 | Ishida | 60/280 |
| 4,852,349 | 8/1989 | Abthoff | 60/303 |

FOREIGN PATENT DOCUMENTS

| | | |
|---|---|---|
| 0086367 | 4/1986 | European Pat. Off. . |
| 3346007 | 7/1984 | Fed. Rep. of Germany . |
| 3606079 | 8/1987 | Fed. Rep. of Germany . |
| 8621939 | 9/1987 | Fed. Rep. of Germany . |
| 59-85415 | 9/1984 | Japan . |

*Primary Examiner*—Douglas Hart

*Attorney, Agent, or Firm*—W. G. Fasse; D. H. Kane, Jr.

[57] ABSTRACT

Diesel engine exhaust gas is cleaned by burning soot to convert the soot into gas. For this purpose the exhaust gas from the diesel engine is caused to travel through a helical or spiral channel, whereby centrifugal force causes soot particles to collect on radially outer, inner circumferential channel surfaces, where the collected soot is combusted by heating elements reaching into these channels, preferably into channel pockets.

14 Claims, 2 Drawing Sheets

APPARATUS FOR CLEANING DIESEL ENGINE EXHAUST GAS

FIELD OF THE INVENTION

The invention relates to an apparatus for cleaning diesel engine exhaust gas, especially for removing soot from the exhaust gas.

BACKGROUND INFORMATION

Efforts to clean diesel exhaust gases, especially to remove soot particles, have been made heretofore. A known device employs ceramic soot filters located in the exhaust gas system of diesel engines. Such filters, however, have the disadvantage that they take up space within the exhaust gas flow ducts and that they require maintenance work. Thus, depending on the capacity of such conventional filters, the required maintenance work, may include regeneration, for example, by cleaning. Otherwise, the filters must be exchanged or otherwise disposed of. Regenerating such filters requires admission of oxygen or air for burning off the soot. The burning of the soot and other filter residues entails the danger that overheating, especially local overheating, can take place, thereby unintentionally destroying the filter.

OBJECTS OF THE INVENTION

In view of the above it is the aim of the invention to achieve the following objects singly or in combination:

to provide a system for cleaning exhaust gases which operates substantially free of maintenance work and which regenerates itself automatically;

to impose on the exhaust gases a smaller flow resistance than is possible with conventional exhaust gas filters; and to use as little space as possible for the exhaust gas cleaning device and to make that device as lightweight as possible.

SUMMARY OF THE INVENTION

The diesel exhaust gas cleaning apparatus according to the invention is characterized in that a portion of the exhaust gas conduit is constructed as a helical or spiral gas flow channel in a housing. Such exhaust gas flow channel has radially outer, inwardly facing surfaces on which soot particles are collected by centrifugal force. Heating elements are arranged to reach through the housing wall into the helical or spiral flow channel for combusting the soot particles.

The cleaning apparatus according to the invention satisfies or achieves the above objectives and additionally has the advantage that the exhaust gas stream which is caused to flow along a helical or spiral path, is exposed to centrifugal forces which ensure an efficient deposition of the soot particles on the radially outer, inwardly facing circumferential surfaces of these helical or spiral channels. These centrifugal forces become effective without any additional drive mechanisms such as rotating radial compressor wheels or centrifugal disks. However, an exhaust gas turbine which may be part of a diesel engine anyway, may be combined with the present cleaning system.

The deposition of the soot particles on the curved inner, radially outer circumferential surface of the flow channel does not diminish the flow cross-sectional area of the exhaust gas channel to an undesirable extent so that the flow resistance remains advantageously substantially unchanged as compared to conventional filters inserted into the exhaust gas flow.

The deposited layer of soot particles is combusted on the curved surface areas of the helical or spiral exhaust gas flow channel with the aid of any remaining oxygen in the exhaust gas flow by means of respectively constructed heating elements. The heat generated by such combustion can be utilized for reducing the heating power of the heating elements, especially where the engine operates on a continuous basis.

In a preferred embodiment soot collecting pockets are provided in the radially outer circumferential surfaces facing inwardly of the helical or spirally shaped conduit forming the exhaust gas flow channel. The heating elements such as glow plugs may be arranged to reach into the soot collecting pockets, whereby the combustion may take place on a continuous basis or at determined time intervals. The combusted or oxidized soot becomes a gaseous component of the exhaust gas flow in which it is entrained for discharging. The present teaching for the removal of soot from a diesel exhaust gas flow functions properly with smooth polished surfaces in the zones of the curved circumferential surfaces of the spiral or helical exhaust gas flow channel, while rough, scrubbed or structurally etched surface zones should be provided in the above mentioned soot collecting pockets where the heating elements such as glow plugs reach into the flow channel.

According to a further aspect of the invention, the present cleaning apparatus may cooperate with an exhaust gas turbine, whereby the rotation energy of the exhaust gas which is generated in the helical or spirally shaped exhaust gas flow channel in the housing can be advantageously utilized by feeding the exhaust gas flow through the exhaust gas turbine inlet into the radial rotor of the turbine.

In another advantageous embodiment of the invention the inwardly facing radially outer circumferential surface of the helical or spiral exhaust gas flow channel may be covered by a porous filter element which simultaneously may constitute the heating element. For this purpose, the filter element material is connected to an electrical current to heat the filter material to a red glowing state so that the deposited soot particles are completely combusted. This filter element can be secured to the entire outer, inwardly facing circumferential surface of the flow channel, or the glowing filter element may only cover partial, selected surface areas. The heating of the filter element may take place continuously or it may be heated at certain time intervals.

In another preferred embodiment, a collecting channel is arranged downstream of the porous heatable filter element so that the cleaned exhaust gas flows into such collection channel and back to the main exhaust gas channel. Such a collection or bypass channel has the advantage that the effective heating surface of the heatable filter element is increased due to the volume flow through the filter pores into the collection channel.

It has been found that the arrangement of the porous filter element is advantageously accomplished in a helical or spiral exhaust gas flow channel having an approximately oval or somewhat elliptical cross-sectional flow area. In such a channel, the bulk of the exhaust gas flow passes through a radially inner cross-sectional zone of the flow channel while a smaller radially outer cross-sectional zone carries the cleaned exhaust gas flow. The heatable filter element is arranged between these two zones.

Semiconductors of the silicon based type are especially suitable for making the heatable filter elements. On the one hand, the semiconductors can be made electrically conducting on their surface by doping elements such as boron or phosphorous while their central core remains highly electrically resistant so that a large heat energy can be achieved with relatively small electrical currents. On the other hand, it is possible to make the semiconductor body sufficiently porous and hence permeable to gases by using semiconductor grains with the addition of pure, but highly doped silicon powder during the sintering process, whereby the individual filter grains become electrically conducting on their surfaces. Simultaneously, the filter body retains the desired high electrical resistance. Yet another advantage is seen in that the semiconductor grains may be shaped into any desired configuration by a mold sintering process. A still further advantage is seen in that the surface of such porous sintered bodies made of silicon produces itself during the heating operation of protective or self-healing surface of silicon dioxide which remains a surface layer during further heating operations. The grain material for making the filter bodies is preferably a relative coarse granular material of silicon carbide with particle sizes within the range of 0.1 mm to 2 mm.

Other suitable heatable materials for making the filters are foamed, felted, or web-type materials of heating metal alloys, provided they have a sufficient resistance to oxidation at the required soot burning temperatures within the range of 230° C. to 800° C. The electrical resistance of such materials is relatively low and thus requires a respectively larger source of electrical current for the soot combustion.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
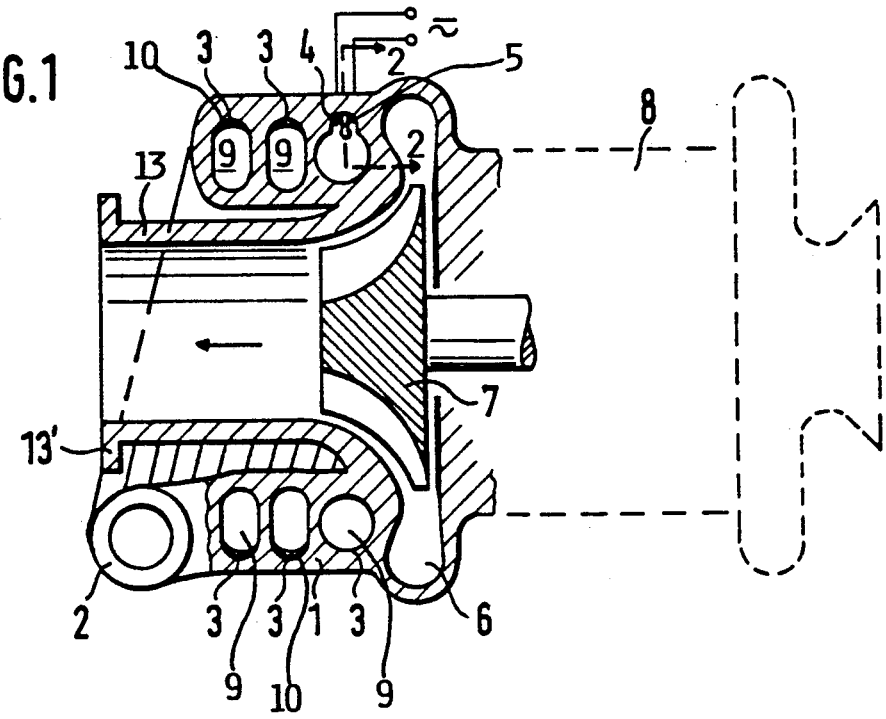
FIG. 1 shows an axial, longitudinal section through a diesel exhaust gas cleaning apparatus according to the invention, having a helical flow channel for the exhaust gas in a respective housing.

FIG. 1 shows a diesel exhaust gas cleaning apparatus according to the invention having a housing 1 with an inlet flange 2 connected to an exhaust of a diesel engine. The engine is not shown. The housing 1 forms an exhaust gas channel 9 having a plurality of windings around an gas exhaust pipe 13 having a flange 13' for connection, for example, to a muffler or the like. The exhaust gas channels 9, or rather the windings thereof, lead from the inlet 2 of the cleaning apparatus into an inlet 6 of an exhaust gas turbine 8 having a radial rotor 7 thereby forming a helical or spiral path for the exhaust gas. Thus, the rotational energy of the exhaust gas produced in the helical or spiral exhaust gas flow channel 9 is applied to the rotor 7 of the exhaust gas turbine 8 after the exhaust gas has been cleaned as will now be described. The clean exhaust gas is discharged through the pipe 13, for example, into a muffler as mentioned.

The soot containing exhaust gas is subjected to a centrifugal force in the exhaust gas flow channel 9, whereby soot particles are caused to deposit as a layer 10 on the radially outer, inwardly facing surfaces 3 of the flow channel 9. According to the invention, the layer 10 of soot particles is subjected to combustion by ignition means 5, for example in the form of a glow plug reaching with its glowing end 5' into and preferably through the soot layer 10, please see FIG. 2.

Figure 2:
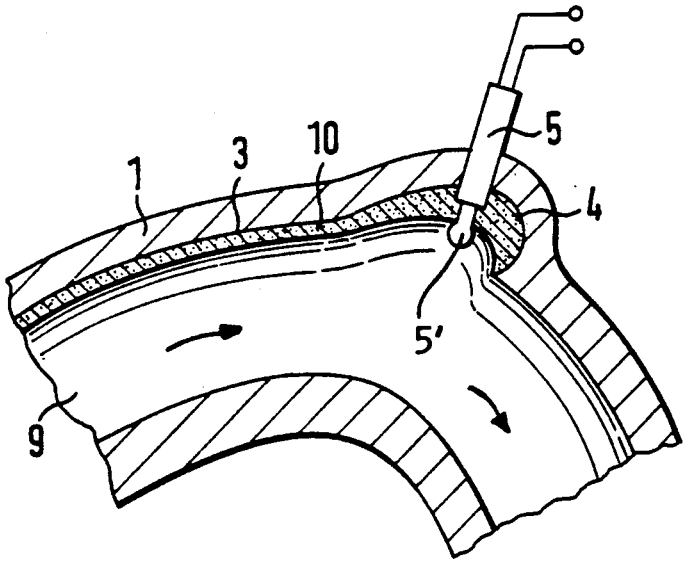
FIG. 2 shows, on an enlarged scale, a sectional view approximately along sectional line or plane 2—2 in FIG. 1, whereby the curvature of the flow channel may be helically or spirally shaped.

Referring to FIG. 2, the housing 1 forming the exhaust gas flow channel 9 is preferably equipped with collecting pockets 4 in which soot particles are trapped. Preferably, the ignition means 5, such as a glow plug reaches through the housing wall into such collecting pockets 4. The ignition means 5 could also be provided in the form of a heatable filter element as will now be described with reference to FIG. 3.

Figure 3:
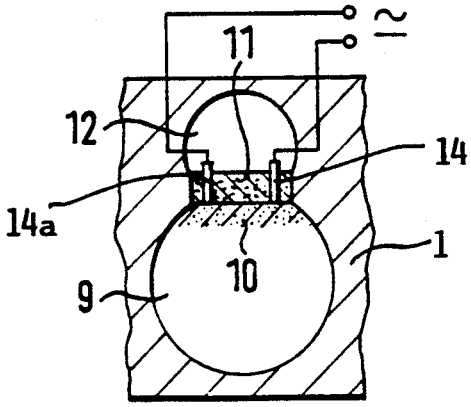
FIG. 3 is a sectional view approximately on the same plane as the sectional view of FIG. 1, of a modified cross-sectional flow area divided into two zones by a filter element.

In FIG. 3 two flow channels 9 and 12 are provided in the housing 1, whereby the smaller diameter flow channel 12 is located radially outwardly of the larger flow channel 9. Together the two flow channels 9 and 12 have a somewhat oval cross-sectional configuration. The flow channel 9 is separated from the flow channel 12 by a filter 11 through which soot particles of the exhaust gases are forced by centrifugal action, thereby forming a soot layer 10 on the radially inwardly facing surface of the filter 11. The soot layer 10 is combusted by heating the filter element 11 with two electrodes 14 and 14*a* connected to an electric source of power. The clean gas is collected in the flow channel 12 which passes the clean gas to the turbine inlet 6 and out through the pipe 13. The porous filter 11 is formed, for example, by sintering as described. The housing 1 and tubular inlet 6 may form an integral housing.

Figure 4:
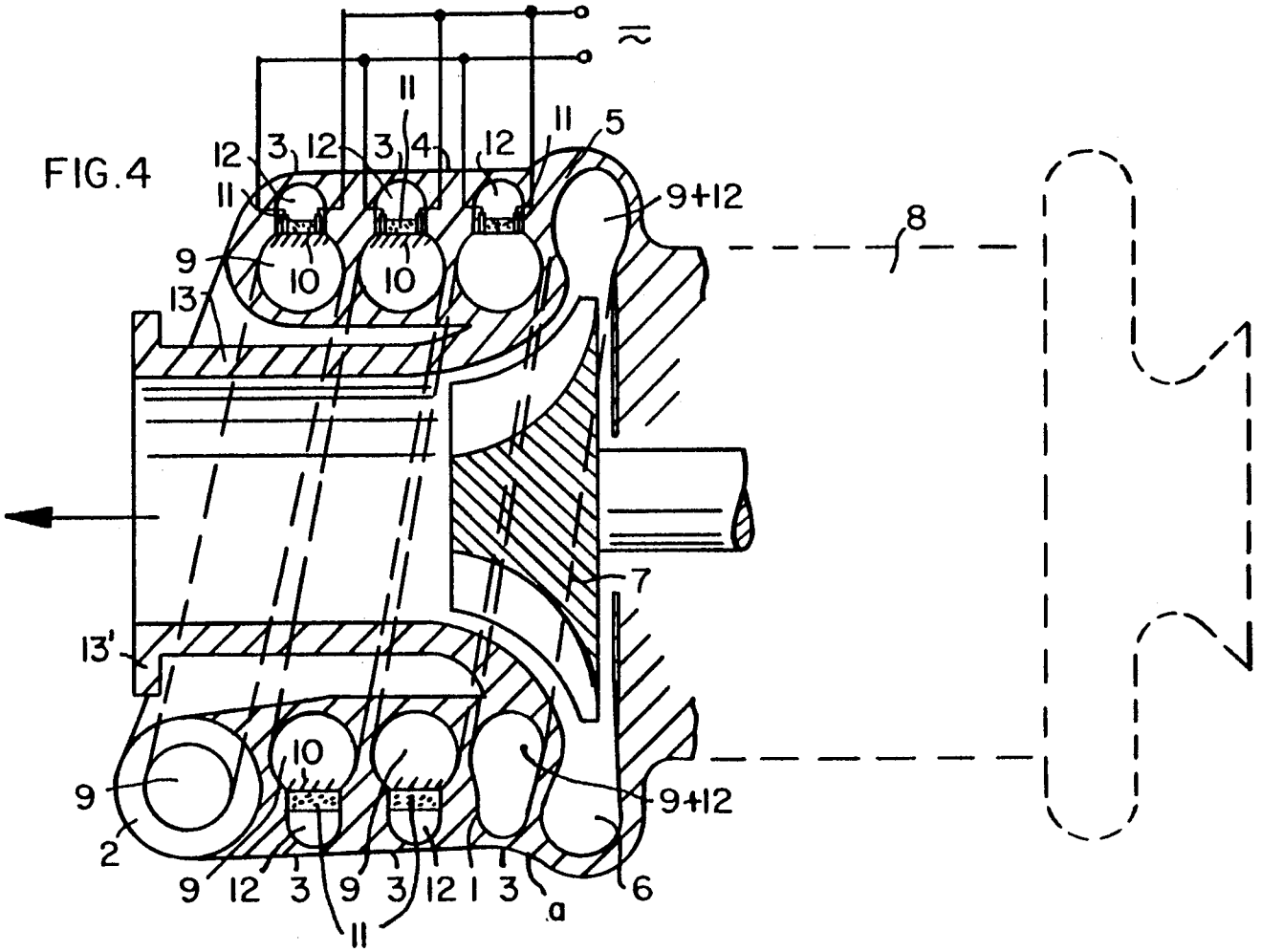
FIG. 4 shows a combination of FIGS. 1 and 3.

FIG. 4 shows the combination of FIGS. 1 and 3. As in FIG. 1, three helical windings of the flow channel sections 9 and 12 run around the gas exhaust pipe 13. As in FIG. 3, a filter 11 is arranged between the two flow channel sections 9 and 12, both of which lead into the turbine inlet 6. Both channel sections 9 and 12 carry clean gas by the time the gas reaches the turbine inlet 6. The gas in channel section 9 is cleaned by the removal of the soot particles by centrifugal action into the filter 11 as described above with reference to FIG. 3. The gas in the channel section 12 is clean because of the filter action of the filter 11.

Although the invention has been described with reference to specific example embodiments, it will be appreciated, that it it is intended to cover all modifications and equivalents within the scope of the appended claims.

It is claimed:

1. An apparatus for cleaning diesel engine exhaust gas, comprising flow channel housing means forming an exhaust gas flow channel having a plurality of windings shaped for causing an exhaust gas flow exposed to centrifugal force, said flow channel housing means having an inlet for connection to an engine exhaust and outlet means for discharging cleaned exhaust gas, said gas flow channel having radially outer, inwardly facing surface areas for collecting soot particles by centrifugal force, heating means positioned for combusting soot collected by said soot collecting surfaces, said exhaust gas flow channel having two channel sections (9, 12) forming said windings, so that one channel section (9) is located radially inwardly of the other channel section (12) and filter means (11) positioned between said two channel sections for forming said soot collecting surfaces.

2. The apparatus of claim 1, wherein said filter means comprises said heating means for heating said filter means.

3. The apparatus of claim 1, further comprising an exhaust gas turbine having a rotor housing with a turbine inlet connected to an end of said gas flow channel housing means, for introducing cleaned exhaust gas into said rotor housing, and a turbine outlet for discharging cleaned exhaust gas.

4. The apparatus of claim 3, wherein said flow channel housing means and said rotor housing form an integral housing structure.

5. The apparatus of claim 4, wherein said turbine outlet (13) passes substantially centrally through said flow channel housing means, and wherein said plurality of windings of said gas flow channel extend around said turbine outlet.

6. The apparatus of claim 1, wherein said plurality of windings of said gas flow channel form a helical gas flow channel.

7. The apparatus of claim 1, wherein said plurality of windings of said gas flow channel form a spiral shaped gas flow channel.

8. The apparatus of claim 1, wherein said filter means are porous filter means, and wherein said heating means are arranged to heat said porous filter means.

9. The apparatus of claim 8, wherein said heating means comprises electrodes connected to said porous filter means.

10. The apparatus of claim 8, wherein said porous filter means are made of a porous semiconductor material, which is constructed to simultaneously form said heating means.

11. The apparatus of claim 1, wherein said filter means is made of porous semiconductor material.

12. The apparatus of claim 1, wherein each of said two channel sections of said gas flow channel has a substantially circular cross-section, said cross-sections merging into each other.

13. The apparatus of claim 10, wherein said porous semiconductor material is silicon carbide.

14. The apparatus of claim 11, wherein said porous semiconductor material is silicon carbide.

* * * * *